US006145440A

United States Patent [19]

Franzén

[11] Patent Number: 6,145,440

[45] Date of Patent: Nov. 14, 2000

[54] TRAINING WEAPON SYSTEM

[75] Inventor: Arne Franzén, Karlskoga, Sweden

[73] Assignee: Simbal AB, Sweden

[21] Appl. No.: 09/147,627

[22] PCT Filed: May 29, 1998

[86] PCT No.: PCT/SE98/01021

§ 371 Date: Mar. 11, 1999

§ 102(e) Date: Mar. 11, 1999

[87] PCT Pub. No.: WO98/55820

PCT Pub. Date: Dec. 10, 1998

[30] Foreign Application Priority Data

Jun. 5, 1997 [SE] Sweden ..... 9702135

[51] Int. Cl.[7] ..... F42B 8/10

[52] U.S. Cl. ..... 102/446; 42/77; 89/29

[58] Field of Search ..... 102/437, 444–447; 42/77; 89/29, 1.703, 1.705, 1.706

[56] References Cited

U.S. PATENT DOCUMENTS 1,538,561 5/1925 Koller ..... 102/446
2,541,025 2/1951 Bluford et al. ..... 102/444
2,857,812 10/1958 Nichols ..... 89/29

FOREIGN PATENT DOCUMENTS 50435 10/1911 Austria .
1156871 11/1983 Canada .

*Primary Examiner*—Harold J. Tudor
*Attorney, Agent, or Firm*—Banner & Witcoff, Ltd.

[57] ABSTRACT

The invention relates to a training weapon system for a portable recoilless anti-armor weapon of the type which comprises a sub-caliber insert barrel (1) arranged in the bore of the launching barrel of the full-caliber weapon. In order to improve the accuracy of the system and make it more safe as well as less expensive when compared to previous systems of this type, the sub-caliber insert barrel (1) has a rifled bore to make the training projectile spin stabilized. The forward aligning member (5) for centering the insert barrel (1) is engaging the ridges of the rifles in the rifled portion of the barrel in the recoilless full caliber weapon. By such an arrangement it can be avoided that length tolerances give rise to undesired radical deviations which might result in a mis-alignment of the insert barrel (1) within the gun bore. This could happen with the forward aligning member engaging the conical, smooth-bored firing chamber in the barrel.

4 Claims, 1 Drawing Sheet

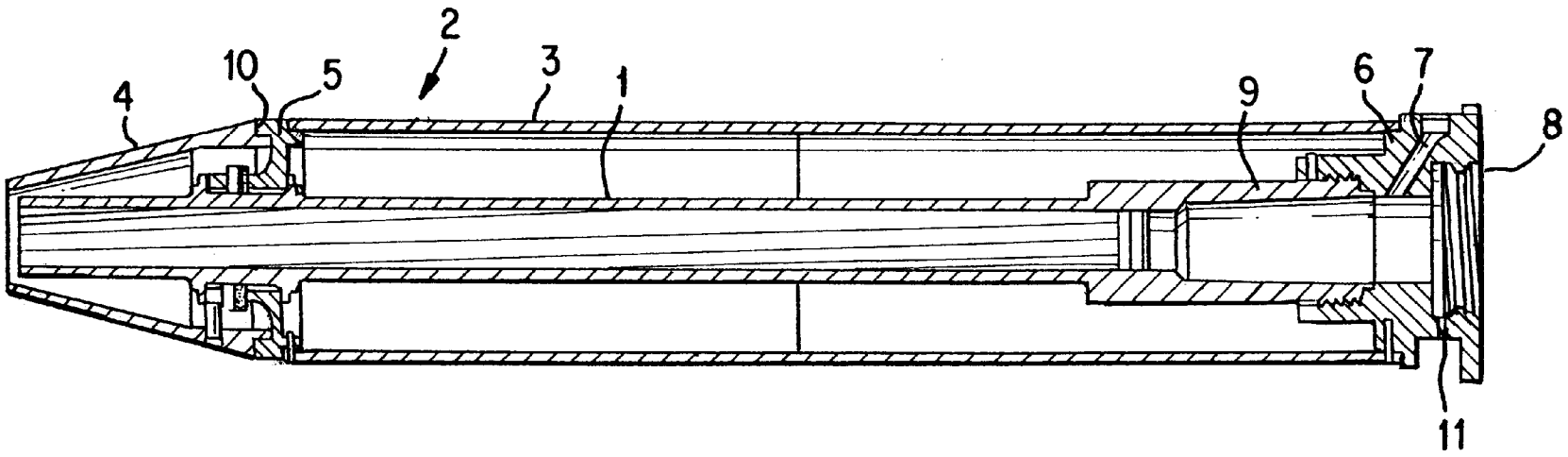
8
7
6
9
1
3
2
5
10
4
11

TRAINING WEAPON SYSTEM

The present invention relates to a training weapon system for a portable recoilless anti-armour weapon of the type which comprises a sub-caliber insert barrel arranged in the bore of the launching barrel of the anti-armour weapon. One example of a recoilless anti-armour weapon in which the invention can be used is the 84 mm Carl Gustaf recoilless gun m/48.

For an effective training of a specific weapon it is important that the soldiers are permitted to fire a large number of ammunition rounds under as realistic conditions as possible. This means that the handling of the weapon and its ammunition should be as close to the real (parent) weapon as possible and the firing experience should also be as realistic as possible. Of course, this is best achieved by allowing full-caliber ammunition rounds also for the training. However, this can rarely be done for economical and safety reasons.

Therefore, it is previously known to use sub-caliber ammunition training weapons. In this case the training weapon has a sub-caliber insert barrel arranged inside the barrel of the parent weapon in question. Specifically, for an 84 mm anti-armour gun m/48 sub-caliber systems of 7.62 mm, 9 mm and 20 mm caliber have been developed. One example of a 20 mm caliber training weapon of this type is illustrated in SE 9400043-7.

The advantage with this type of training weapon systems is the fact that the soldier is allowed to fire a sub-caliber instead of an expensive full caliber ammunition round. He can well study his ability to hit the target. However, in the 7.62 mm as well as in the 9 mm system, the firing experience is quite different from the real, live conditions. The soldier does not experience the sudden sound and gas pressure which is generated in the corresponding service weapon system. In order to simulate the specific out-blow effect at the rear of the weapon an additional charge has to be applied in these systems. This charge is detonated at the firing moment in order to give the soldier a more realistic training experience with respect to the generated sound and shock waves.

The 20 mm training system, however, provides a realistic sound level around the weapon and this system also provides an out-blow effect because of its recoilless function. The sub-caliber barrel is disposed in the bore of the full-caliber weapon in a body shaped as a round of ammunition similar to the full-caliber high explosive shell. The sub-calibre barrel is smooth-bored. However, the accuracy of such a system is unsatisfactory as soon as the firing distance exceeds 250 m.

Furthermore, in some cases it has happened that the so-called nozzle screw has been unscrewed at the firing and thrown rearwards with a high safety risk for personnel behind the weapon.

Recoilless ammunition round of this type also have a plastic bottom plate member which is broken when the round is fired. When the bottom plate member is broken it is divided into small splinters which could be dangerous up to 70 m behind the weapon. This can be compared with a required safety distance of 15 m for the service weapon under war conditions.

The object of this invention is to provide a sub-caliber weapon system for training purposes in which the accuracy and safety has been improved but at reduced cost compared to previous systems of this kind. According to the invention this is achieved by providing the sub-calibre insert barrel with a rifled bore and arranging the insert barrel so that the forward aligning member of the barrel is engaging the ridges of the rifling in the rifled section of the full-caliber weapon.

In the following the invention will be described more in detail in connection with a 20 mm training weapon system for an 84 mm gun m/48 and which is schematically illustrated on the accompanyed drawing.

The reason for choosing caliber 20 mm system is the fact that such a system provides a realistic sound level around the weapon, as already mentioned. It also seems as if a caliber around 20 mm has an optimal cost efficiency relative to the required training and feeling experience. The sound-level for a 20 mm system is approximately 170 dB to be compared with approximately 180 db for the full-caliber version. The duration of the sound wave (A-duration) is approximately ⅓ of the real system and is experienced as fully satisfactory.

The training weapon comprises an insert barrel 1 for a sub-caliber projectile. The insert barrel is mounted in a body 2 shaped as an ordinary ammunition round and which is loaded in the gun in the same manner as the ordinary full-caliber round. The body 2 has a conventional, elongated cylindrical portion 3 and a conical forward portion 4 and a calibre of 84 mm. The insert barrel 1 is mounted in the body 2 by means of a forward aligning member 5 for centering the barrel and a rear breech block 6 with an ignition channel 7 and threads 8 for the nozzle screw. The rear part of the barrel has a conventional firing chamber 9 for the training projectile.

As shown in FIG. 1 the axial length of the conical portion 4 is about 22% of the length of the entire elongated cylindrical portion 3.

According to the invention the insert barrel 1 has a rifled bore instead of being smooth-bored like previous training weapons of the insert type. This means that the projectile cost is reduced, as a spin stabilized projectile is less expensive to manufacture than a fin stabilized projectile. It should also be understood that for a given projectile caliber a reduction of the air resistance is more easily achieved for a spin stabilized projectile compared to a fin stabilized projectile. As the training ammunition should have the same trajectory as the corresponding live ammunition, the retardation of the projectile in each point of the trajectory should be as similar to the corresponding live projectile as possible. This is achieved if the ratio of the projectile mass to the air resistance area is the same for the two types of ammunition units. Consequently, a spin stabilized projectile can be made with a less projectile mass compared to a corresponding fin stabilized projectile. As a result the amount of powder could be reduced which means a less expensive product.

The accuracy of a spin stabilized training weapon system is also improved due to the inherent stability in such a system. It is well known that it is very difficult to provide a corresponding accuracy in a fin stabilized system.

In order to further improve the accuracy of the training system the forward aligning member 5 of the weapon is engaging the ridges of the rifling of the rifled portion in the bore of the gun barrel instead of engaging the conical (not rifled) firing chamber portion of the gun like in other similar training systems. By such an arrangement it could be avoided that any length tolerances give rise to undesired radial deviations resulting in a mis-alignment of the insert barrel in the gun.

The forward aligning member 5 is made as an annular sleeve having a circumferential portion 10 forming the contacting surface against the projecting ridges of the rifling. The longitudinal dimension of the contacting surface exceeds the width of a rifle groove so that the aligning member 5 bridges a rifle groove and is contacting the projecting part (ridges) of the rifling only. By allowing the aligning member to engage the ridges only, i.e. in the rifled portion of the bore, the aligning member can be located in a more forward position compared to the previous location inside the firing chamber, which is behind the rifled portion of the gun barrel. In this case this means that the aligning member can be located in the most forward position on the cylindrical portion 3 of the shell-formed body.

To prevent the nozzle screw to unscrew when the ammunition round is fired a vent hole 11 is made in the cylindrical wall of the breech block to reduce the pressure on the nozzle screw. Any gas leakage at the rear surface of the cartridge case can then escape through this hole instead of passing through the threads 8, like in other systems. The risk for an unintentional unscrewing of the nozzle screw can then be eliminated.

The design of the rear portion of the weapon with the breech block, the nozzle and the screw is not part of this invention and will not be described in any detail here. Nor is the ammunition round per se described in this connection. In order to reduce the risk for harmful splinters behind the weapon, and thereby improve the safety, a bottom plate member according to SE 9501344-7 can be used. In this way the safety distance can be reduced from 70 m to 15 m.

The invention is not limited to the training weapon which has been illustrated here as an example, but can be varied within the scope of the following claims.

What is claimed is:

1. A training weapon system for a portable recoilless anti-armor weapon comprising a practice cartridge, said weapon having a barrel with a rifled bore therein, said rifled bore containing spiralled ridges, with depressed lands therebetween;

said practice cartridge comprising a casing with a rear surface, an elongated cylindrical portion (3) and a conical forward portion (4), and a chamber for containing a sub-caliber projectile, said elongated cylindrical portion of said practice cartridge having a uniform outside dimension throughout its length equal to an ammunition round for said weapon, and filling a chamber of the portable recoilless anti-armor weapon when it is inserted, said conical forward portion forming a uniformly inclined line in cross-section, said conical forward portion having an axial length of about 22% of the length of the elongated cylindrical portion, said practice cartridge having a sub-caliber insert barrel (1) with its axis congruent with the axis of the barrel of said weapon when said practice cartridge is inserted into the firing position inside of the weapon, said insert barrel (1) having a rifled bore to provide spin stabilization of the sub-caliber projectile, said practice cartridge having a forward aligning member (5) placed axially between and in contact with said elongated cylindrical portion and said forward conical portion, for aligning said insert barrel inside said weapon, said aligning member comprising an annular sleeve with a central aperture comprising an inner circumference, and an outer circumference, said inner circumference of said aligning member fitting around the forward portion of said insert barrel, said outer circumference having a contact surface (10) engaging said ridges of the rifled bore of said recoilless weapon, said contact surface having a longitudinal extension exceeding the axial width of a rifle groove, so that the aligning member bridges adjacent rifle grooves and is engaging only the projecting ridges of only the rifles of said recoilless weapon.

2. The training weapon system according to claim 1 characterised in that said sub-caliber insert barrel (1) has a caliber of 20 mm.

3. The training weapon system of claim 1 characterized in that said insert barrel is mounted at the rear of the practice cartridge in a breech block (6) with a nozzle screw thread (8).

4. The training weapon system according to claim 3 characterised by a vent hole (11) made in a cylindrical wall of the breech block to provide an exit for a possible gas leakage.

* * * * *

UNITED STATES PATENT AND TRADEMARK OFFICE

CERTIFICATE OF CORRECTION

PATENT NO. : 6,145,440
DATED : November 14, 2000
INVENTOR(S) : Arne Franzen

It is certified that error appears in the above-identified patent and that said Letters Patent is hereby corrected as shown below:

Title page,
Item [56] References Cited, under U.S. Patent Documents:

| | | | |
|---|---|---|---|
| "2,826,145 | 03/1958 | Sandberg, et al. | 102/41 |
| 2,837,028 | 06/1958 | Fransson | 102/41 |
| 3,638,571 | 02/1972 | Gawlick, et. al. | 102/41 |
| 4,711,180 | 12/1987 | Smolnick | 102/445 |
| 5,811,715 | 09/1998 | Asbrink | 89/29 |
| 5,900,575 | 05/1999 | Johannson, et. al. | 89/1.706" has been inserted. |

Item [56] Foreign Patent Documents,

| | | |
|---|---|---|
| "WO92/16815 | 10/1992 | PCT |
| EP 0 056 076 | 07/1982 | European |
| WO85/01341 | 03/1985 | PCT" has been inserted. |

Signed and Sealed this

Thirteenth Day of November, 2001

*Attest:*

Nicholas P. Godici

NICHOLAS P. GODICI
*Acting Director of the United States Patent and Trademark Office*

*Attesting Officer*